US005996949A

United States Patent [19]

McCraney

[11] Patent Number: 5,996,949

[45] Date of Patent: Dec. 7, 1999

[54] WATER HEATER STAND WITH SEISMIC CLIPS

[76] Inventor: W. Jeffrey McCraney, 1918 W. Chestnut St., Santa Ana, Calif. 92703

[21] Appl. No.: 09/093,640

[22] Filed: Jun. 9, 1998

[51] Int. Cl.[6] ..... F16M 13/00

[52] U.S. Cl. ..... 248/158; 348/154; 52/263

[58] Field of Search ..... 348/158, 146, 348/176.01, 154, 172, 149; 52/263; 108/157.1, 158.12, 157.18

[56] References Cited

U.S. PATENT DOCUMENTS

| | | | |
|---|---|---|---|
| 1,182,564 | 5/1916 | Holden | 248/172 |
| 1,321,305 | 11/1919 | Heald | 248/172 |
| 1,694,000 | 12/1928 | Cole | 248/172 |
| 4,267,998 | 5/1981 | Weirich | 248/172 |
| 4,344,645 | 8/1982 | Kirk | 248/172 |
| 5,199,676 | 4/1993 | Kowalewski | 248/149 |
| 5,368,263 | 11/1994 | Harrison | 248/146 |
| 5,487,518 | 1/1996 | McCraney et al. | 248/146 |
| 5,685,509 | 11/1997 | Harrison | 248/146 |

*Primary Examiner*—Ramon O. Ramirez
*Assistant Examiner*—Kimberly Wood
*Attorney, Agent, or Firm*—Edgar W. Averill, Jr.

[57] ABSTRACT

A stand for supporting a water heater above a floor while permitting the storage of objects under the stand. The stand has a rectangular top fabricated from sheet metal. Four vertical legs extend downwardly from the top and the top and the legs have first and second inwardly turned flanges along their edges. Seismic clamps may be slid along these inwardly turned flanges so that they rest over the position of a stud behind wallboard so that the stand can be secured to a wall to hold the hot water heater securely during an earthquake.

2 Claims, 2 Drawing Sheets

FIG. 4
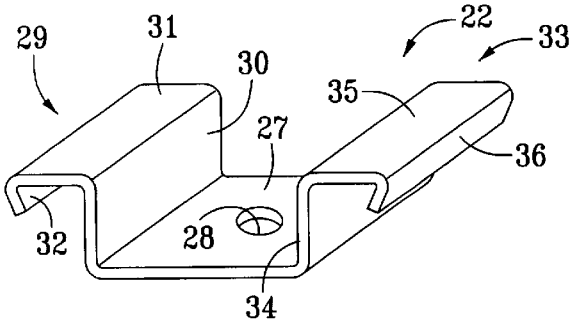
FIG. 5
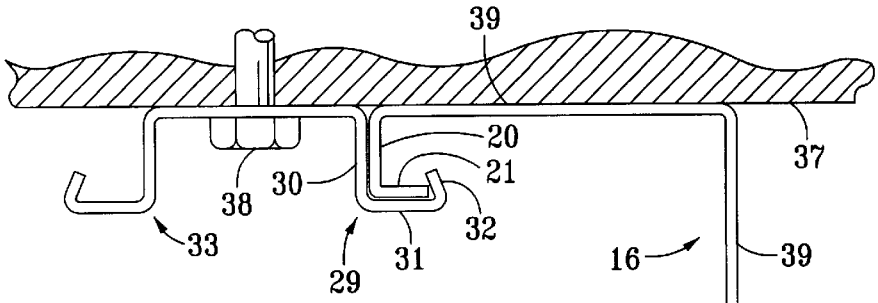
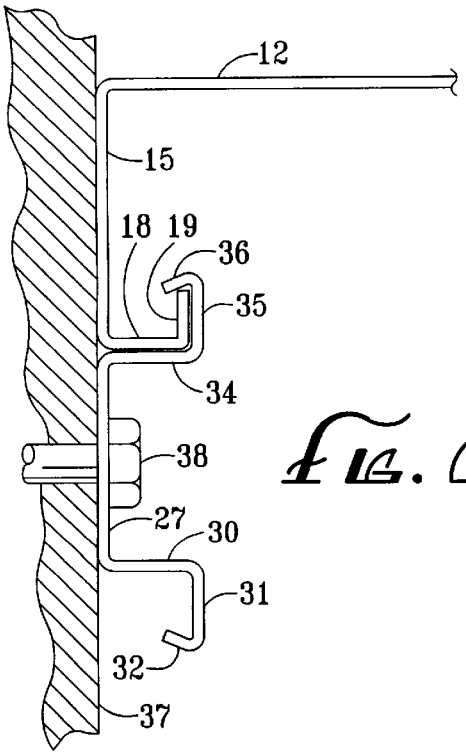
FIG. 6

WATER HEATER STAND WITH SEISMIC CLIPS

BACKGROUND OF THE INVENTION

The field of the invention is stands and the invention relates more particularly to stands for supporting hot water heaters in a way so that the hot water heater can withstand an earthquake.

It has been determined that it is safer to support a hot water heater about 18" above a floor. In the event gasoline is spilled on a garage floor which garage has a hot water heater positioned therein, the gasoline is much less likely to explode if the hot water heater is supported about 18" or more above the floor. The vapors tend to flow along the floor and do not extend to a height of 18" in most cases.

Various stands have been devised for this purpose. One such stand is in U.S. Pat. No. 4,267,998 which is fabricated from wood. The wooden panels are rectangular and slots are provided to facilitate assembly. A metal water heater stand is shown in U.S. Pat. No. 5,199,676. This stand is assembled on site and does not have means for affixing it to a wall for seismic protection.

U.S. Pat. Nos. 5,368,263 and 5,685,509 show water heater stands which are fabricated from plastic which do not permit the storage of anything under the water heater stands.

Applicant's U.S. Pat. No. 5,487,518 shows a clamp for holding a water heater against a wall.

BRIEF SUMMARY OF THE INVENTION

It is an object of the present invention to provide a water heater stand which is open beneath the stand for storage purposes of non-flammable materials and which stand may be clamped to a wall for seismic protection.

The present invention is for a stand for supporting a water heater above a floor. The stand has a rectangular horizontal top having four corners fabricated from sheet metal. The top has four downwardly turned sides, each of the downwardly turned sides having an inwardly and upwardly turned flange, except adjacent the corners. Four vertical legs are fabricated from sheet metal bent to form a right angle, the legs having two side faces which are affixed to the corners of the rectangular top, each edge of the leg having a right angle bent flange which has a second inwardly turned right angle flange. Preferably, the top and one or two of the legs are clamped to a wall. The clamp used to secure the stand has a clamp face with a hole centrally located. The clamp face has a first attachment hook which has a side extending outwardly from the face, a flange extending away from the side and a second inwardly extending flange extending from the first flange so that the clamp may be hooked onto the flange of the top or the flange of the leg for securing to a wall. The present invention is also for the process of securing the water heater stand to a wall. The stand is placed so that one of its sides is adjacent a wall surface. Next a stud is located behind the wallboard of the wall surface. A seismic clamp is affixed under the flange of the top or the leg and slid so that it is opposite one of the studs. Next, the clamp is secured to the stud, thereby holding the stand against the wall.

BRIEF DESCRIPTION OF THE DRAWINGS

FIG. 4 is a perspective view of a seismic clamp used with the stand of FIG. 1.

FIG. 5 is a top view of a leg of the stand of FIG. 1 affixed to a wall with the clamp of FIG. 4.

FIG. 6 is a side view showing a portion of the top of the stand of FIG. 1 clamped to a wall with the clamp of FIG. 4.

DESCRIPTION OF THE PREFERRED EMBODIMENTS

Figure 1:
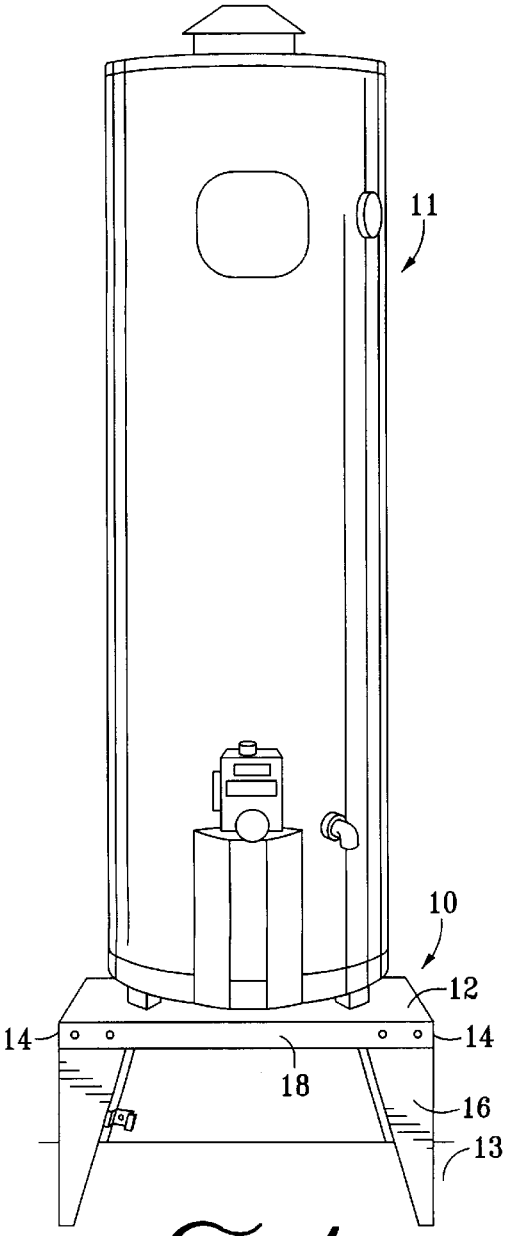
FIG. 1 is a perspective view of the water heater stand of the present invention with a water heater placed thereon.

The water heater stand is shown in perspective view in FIG. 1 and indicated generally by reference character 10. A water heater 11 is shown resting on the rectangular horizontal stand top 12. The stand top is preferably about 16" above floor 13 so that the pilot flame (not shown) of water heater 11 is at least 18" above floor 13. In this way the stand is far less likely to ignite any spilled gasoline or other flammable liquid.

Figure 2:
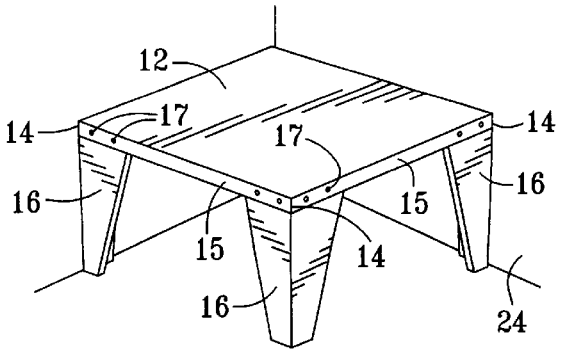
FIG. 2 is a perspective view of the stand of FIG. 1.

Stand 10 has four corners 14 and four downwardly turned sides 15. Four legs 16 are secured by rivets 17 to the downwardly turned sides 15. As shown best in FIG. 2, each leg 16 is secured by four rivets 17 around corner 14.

Figure 3:
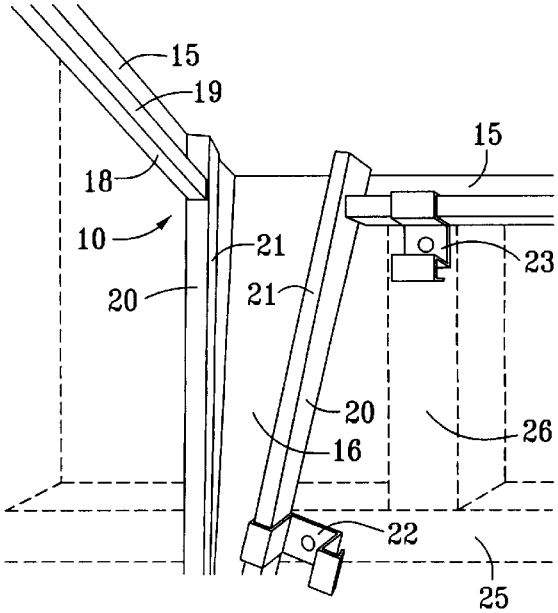
FIG. 3 is a perspective view showing the underside of one corner of the flange and the inside of one of the legs of the stand of FIG. 1.

The stand is preferably fabricated from galvanized steel having a top with a a thickness of about 18 gauge and the legs fabricated from 20 gauge. Water heaters can weigh up to 500 lbs. and it has been found that the water heater stand of the present invention is capable of holding in excess of such weight. The details of the flanges of the top and the leg of stand 10 are shown in FIG. 3 where downwardly turned side 15 can be seen to have an inwardly turned flange 18 and an upwardly turned flange 19. These terminate as shown in FIG. 3 where the leg 16 is attached to the two adjacent downwardly turned sides 15. Each leg also has a right angle bent flange 20 and a second inwardly turned right angle flange 21.

A pair of seismic clamps 22 and 23 are shown in FIG. 3 holding the stand 10 to a wall 24. Wall 24 is covered with wallboard behind which there is a plate 25 and a series of vertical studs 26. Because of the relative shape of clamps 22 and 23 and the flanges, the clamps may be slid to a position where they may be secured to a stud or a plate.

The details of the clamps are shown in FIG. 4 where clamp 22 is shown which is identical to clamp 23. Clamp 22 has a clamp face 27 which has a hole 28 through which a lag screw 38 may be passed. Two different attachment hooks are formed on each side of face 27. A leg attachment hook 29 has a side 30 extending away from face 27. A first flange 31 extends away from side 30 and a second flange 32 extends inwardly from first flange 31. The second hook is a top attachment hook 33 which has a top side 34 extending away from clamp face 27. A first top flange 35 extends away from side 34 and a second top flange 36 extends inwardly from flange 35. Thus, clamp 22 is capable of being attached to flanges of different sizes. Leg attachment hook 29 is larger than top attachment hook 33. This is because the leg attachment flange is larger than the top attachment flange. Preferably, indicia are provided on the clamp face to indicate which side goes to which piece.

The leg attachment hook is shown affixed to leg 16 in FIG. 5. The table with its attached legs is placed against the surface of wallboard 37. Clamp 22 is placed over the second inwardly turned flange 21 so that its second flange 32 extends over the edge of flange 21. The first flange 31 of clamp 22 extends over the second inwardly turned flange 21 and the side 30 of clamp 22 extends over the right angle bend 20 so that the clamp face 27 abuts wallboard 37. As stated above, clamp 22 is slid to a position where its hole 28 overlies a plate or a stud so that the lag screw 38 can be securely affixed to the wall.

FIG. 6 shows how top 12 is secured against wallboard 37. The top attachment hook 33 is hooked over the upwardly turned flange 19 of top 12 so that the second flange 36 passes over the top of flange 18. In this way, clamp 23 may be hooked over the flange under the top and slid to a desired location without the necessity of holding the clamp 23 up since it is supported by second top flange 36. As above, it is slid to a position where hole 28 overlies a stud as shown in FIG. 3 and indicated by reference character 26 so that lag screw 38 may be screwed into a stud to securely hold clamp 23, and thus, securely hold top 12 against the wall. Clamps 22 and 23 are, of course, identical and merely oriented so that the appropriate hook is placed over the appropriate flange. It is preferably fabricated from 14 gauge galvanized sheet metal and provides a very secure attachment of the table even when it supports a water heater.

While the table is shown with its legs riveted to the top, it can also be supplied in a knock-down version where the legs are bolted to the top in place of the rivets. In this way the table can be packaged in a relatively compact box for shipping and storing at a retail outlet. In the event that there is a concrete curb extending outwardly beyond the wallboard, a spacer board is used between the edge of the table and the wallboard with the spacer board being nailed securely to the studs.

While the legs are shown as tapered, they can, of course, be straight. Because the table is open below the top 12, it is possible to store articles below the table which is not possible with many designs.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A process of securing a water heater stand to a wall of the type having wall board held by vertical studs supported on a horizontal plate, said stand having a rectangular, horizontal stand top having four corners, said top being fabricated from sheet metal having four downwardly turned sides, each of said downwardly turned sides having an inwardly and an upwardly turned flange except adjacent each corner where there is no flange, four vertical legs, each leg being fabricated from sheet metal bent to a right angle to form two side faces and affixed to said top at each corner thereof where one of said two side faces is adjacent one of said downwardly turned sides and the other of said two side faces is adjacent another of said downwardly turned sides, each leg having two generally vertical edges, each edge having a right angle bent flange which has a second inwardly turned right angle flange, said process comprising:

placing said stand so that one of its downwardly turned sides and at least one leg are against a wall surface to provide a wall touching side and a wall touching leg;

locating a stud behind said wall board along said wall touching side;

affixing a seismic clamp having a clamp face, a side extending outwardly from said face, a first flange extending away from said side and a second flange extending inwardly from said first flange so that its second flange extends over said upwardly turned flange of said downwardly turned side;

sliding said seismic clamp along said upwardly turned flange until it rests over said stud; and screwing said seismic clamp to said stud.

2. The process of claim 1 further including the step of affixing a second seismic clamp having a clamp face, a side extending outwardly from said face, a first flange extending away from said side and a second flange extending inwardly from said first flange so that its second flange extends over said second inwardly turned flange of said wall touching leg;

sliding said seismic clamp along said inwardly turned flange until said seismic clamp rests over said plate; and screwing said seismic clamp to said plate.

* * * * *